US006797364B2

(12) United States Patent
Okada et al.

(10) Patent No.: US 6,797,364 B2
(45) Date of Patent: Sep. 28, 2004

(54) COMPOSITE PANEL

(75) Inventors: Norihisa Okada, Hikari (JP); Wataru Kawamura, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 99 days.

(21) Appl. No.: 09/805,055

(22) Filed: Mar. 14, 2001

(65) Prior Publication Data

US 2002/0157768 A1 Oct. 31, 2002

(30) Foreign Application Priority Data

Mar. 16, 2000 (JP) ..... 2000-079276

(51) Int. Cl.[7] ..... B32B 3/00; B32B 3/16; B32B 3/14; B32B 3/12; E04C 2/34

(52) U.S. Cl. ..... 428/174; 428/116; 428/189; 428/121; 428/192; 428/77; 428/78; 428/72; 52/793.1; 52/783.1

(58) Field of Search ..... 428/174, 189, 428/116, 72, 76, 77, 78, 59, 192, 121; 52/793.1, 783.1

(56) References Cited

U.S. PATENT DOCUMENTS

| | | | | | |
|---|---|---|---|---|---|
| 1,207,734 | A | * | 12/1916 | Feeley | 428/59 |
| 2,607,104 | A | * | 8/1952 | Foster | 428/101 |
| 2,664,835 | A | * | 1/1954 | Sorensen | 428/77 |
| 2,774,699 | A | * | 12/1956 | Clark | 428/136 |
| 3,222,769 | A | * | 12/1965 | Le Plae | 29/413 |
| 3,549,466 | A | * | 12/1970 | Kay et al. | 428/38 |
| 3,890,108 | A | * | 6/1975 | Welsh | 428/593 |
| 4,078,959 | A | | 3/1978 | Palfey et al. | 156/214 |
| 4,188,765 | A | * | 2/1980 | Jackson | 52/716.8 |
| 4,917,747 | A | * | 4/1990 | Chin et al. | 156/198 |
| 5,160,771 | A | * | 11/1992 | Lambing et al. | 428/57 |
| 5,491,032 | A | * | 2/1996 | Verschaeren | 428/461 |
| 5,496,610 | A | * | 3/1996 | Landi et al. | 428/73 |
| 5,763,047 | A | * | 6/1998 | Green | 428/141 |
| 5,919,545 | A | * | 7/1999 | Giezendanner et al. | 428/116 |

FOREIGN PATENT DOCUMENTS

| | | |
|---|---|---|
| JP | 5428373 | 3/1979 |
| JP | 62196132 | 8/1987 |

* cited by examiner

*Primary Examiner*—Harold Pyon
*Assistant Examiner*—Catherine A. Simone
(74) *Attorney, Agent, or Firm*—Antonelli, Terry, Stout & Kraus, LLP

(57) ABSTRACT

A composite panel having a non-adhesion portion is mounted on a stationary table and a bending table and is fixed thereto by vacuum adsorption pads. An upper portion bending table is mounted on a face sheet providing the non-adhesion portion. The face sheet is secured using the vacuum adsorption pad on the bending table. The bending table is rotated, so that the face sheet is bent. The center core member is cut with a V-shape. An adhesion agent is coated. Next, by rotating the lower bending table, the other face sheet and the center core member are bent so that the core member is adhered to the upper face sheet. Without causing a gap between a face sheet and a center core member and a partial contact, an integral bending processing of a flat sheet shape composite panel can be realized. In addition to this, to assurance adequate strength in a bending processing portion of the composite panel, it is unnecessary to provide a separate member and the like.

29 Claims, 4 Drawing Sheets

COMPOSITE PANEL

BACKGROUND OF THE INVENTION

The present invention relates to a composite panel having an angular bend and to a bending processing method of producing such a composite panel.

In the production of a known composite panel using a bending processing method of providing the composite panel with an angular bend, two face sheets and a center core member are positioned so that the center core member is interposed between the two face sheets. Next, using a monopoly type die having a pair of die members, including a convex type die member and a concave type die member, and a pressing device, the two face sheets and the center core member are adhered to one another and fixed together while simultaneously producing an angular bend therein. Or, for example, using a monopoly die having a convex type die member, the two face sheets and the center core member, formed of a non-ventilation characteristic sheet, are joined by pressing while evacuating an inner portion of the sheet, so that the two face sheets and the center core member are adhered to one another and fixed together while producing an angular bend therein.

In another bending processing method of producing a composite panel, as shown in Japanese application utility model publication No. Hei 2-8567, from a side of a face sheet which represents an inner periphery, after bending the inner sheet portion of the composite panel, while the face sheet which forms the outer periphery after the bending of the composite panel is left, a V-shaped groove is processed, and, along an apex of this groove, the face sheet which forms the outer periphery of the composite panel is subjected to bending processing.

In the abovedescribed techniques relating to a bending processing method of producing a composite panel, while still separate from the center core member, the face sheet is transformed to have a predetermined bending shape, and then, the face sheet is combined with the center core member to cause the face sheet and the center core member to be adhered to each other and fixed together, and this is carried out by hand working using a general purpose machine.

Further, the face sheet and the center core member, which are transformed individually using a monopoly-types die having a convex type die member and a concave type die member (a monopoly type having an upper portion monopoly die and a lower portion monopoly die) and pressing device, or for example a concave type monopoly die member (the lower monopoly die), are covered by a non-ventilation characteristic sheet member, and the inner portion of the sheet member and the face sheet and the center core member are adhered to each other and fixed together.

A mutual gap and partial contact (a local application of pressure) between the center core member, the face sheet and the monopoly die are provided, and an adhesion failure and a buckling in the thickness direction of the center core member are produced, so that the strength of the face sheet is reduced. Further, in the face sheet in which partial contact (the local application of pressure) generates a recessed portion, damage and the like, the outer appearance of the face sheet becomes unsightly.

SUMMARY OF THE INVENTION

An object of the present invention is to provide a composite panel having an angular bend and a bending processing method of producing such a composite panel in which the occurrence of a gap or partial contact (the local application of pressure) between the face sheet and the center core member is eliminated, so as to provide an angular composite panel having a high strength.

Another object of the present invention is to provide a composite panel having an angular bend and a bending processing method of producing such a composite panel wherein the panel is produced without the need for a monopoly die for every bending configuration, and in which both a composite panel having an angular bend and a bending processing of a composite panel can be realized in such a way as to provide an angular composite panel having a high strength.

The above-stated objects of the present invention can be attained by a composite panel comprising a first flat face sheet, a second flat face sheet, and a flat center core member joined to the first flat face sheet and the second flat face sheet, characterized in that an end portion of the second flat face sheet is positioned so as to be shorter than an end portion of the first flat face sheet, and the surface of the center core member at the end portion facing the second flat face sheet is not joined to the second flat face sheet prior to the bending processing.

The above-stated objects of the present invention can be attained by a bending processing method of producing a composite panel having the steps of forming a first flat face sheet, a second flat face sheet, and a flat center core member to be joined to the fiat flat face sheet and the second flat face sheet; preparing a composite panel in which a portion of the second fiat face sheet is not joined to the flat center core member on the end portion of the composite panel by installing the first flat face sheet on a stationary table and a first bending table and beneath a second bending table, so as to extend along the stationary table and the first bending table; bringing the second bending table into contact with the non-joined region of the second flat face sheet from above the composite panel, under a condition in which the stationary table is fixed to the composite panel and the second bending table is fixed to the non-joined region of the second flat face sheet; rotating the second bending table in a direction to separate the non-joined portion of the second flat face sheet from the center core member; removing a portion of the flat center core member at the position in which the composite panel is bent to form a V-shaped groove; coating an adhesion agent to the inside surface of the second flat face sheet and an opposed face of the flat center core member; and rotating the first bending table to adhere the flat center core member to the second flat face sheet.

The composite panel in accordance with the present invention can be applied to a polystyrene foam panel and a soldering honeycomb panel. The material of the face sheet can be a metal, such as aluminum, a FRP (Fiber Reinforced Plastic) and paper, etc. The material of the center core member can be a honeycomb-shaped paper, a honeycomb shaped FRP (Fiber Reinforced Plastic), and a foam material, such as vinyl chloride, phenylic acid phenol), acrylic acylate, or urethane. The joining of the center core member with the face sheet can be effected by soldering, adhesion, and welding, etc.

DESCRIPTION OF THE INVENTION

Figure 1:
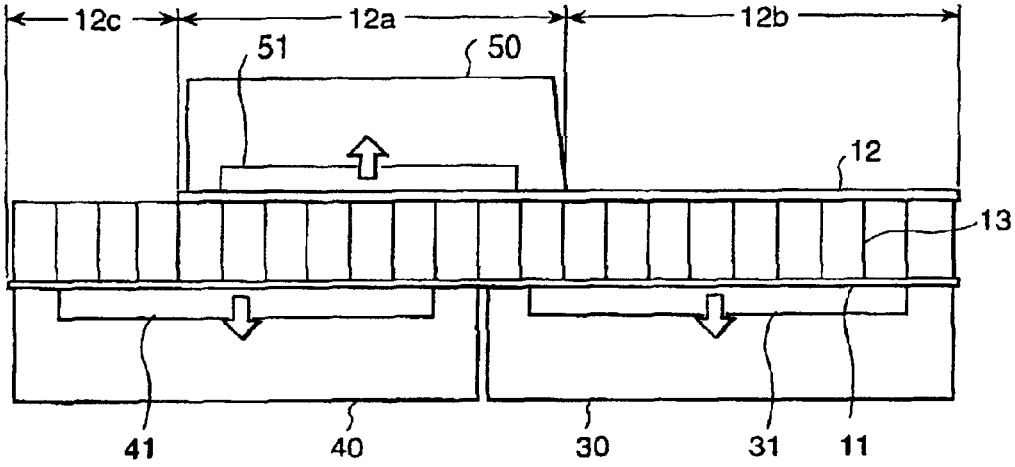
FIG. 1 is a longitudinal cross-sectional view showing an initial state of an essential portion of a bending processing device having a composite panel mounted thereon according to one embodiment of the present invention.

A composite panel having an angular bend and a bending processing of a composite panel according to one embodiment of the present invention will be explained with reference to FIG. 1 to FIG. 5. Firstly, the construction and element materials of a composite panel for carrying out a bending processing will be explained. In FIG. 1, the composite panel to be subjected to bending processing comprises a face sheet 11, which represents a side forming an outer face of the panel at the time of use, a face sheet 12, which represents a side forming an inner face of the panel at the time of use, and a center core member 13, which is arranged between the face sheet 11 and the face sheet 12. These three members (the face sheet 11, the face sheet 12, and the center core member 13) are constituted as one body using an adhesion method.

Each of the face sheet 11 and the face sheet 12 is formed of a metal sheet, such as an aluminum sheet, a steel sheet and the like. Further, each of the face sheet 11 and the face sheet 12 can be formed by the above-stated metal sheet and a vinyl chloride adhesion dressing sheet or a melanin resin dressing sheet etc. which is adhered thereto by coating, and the thickness of the face sheet 11 or the face sheet 12 is about 0.5 mm–2.0 mm.

The center core member 13 is formed by a paper center core member, such as a roll core and a paper honeycomb; and, further, the center core member 13 is provided with a urethane-foam resin, which is filled up in the cells of the paper center core member, so as to provide heat insulation and sound shielding using the resilient urethane-foam resin, and the thickness the center core member 13 is about 20 mm–50 mm.

The entire surface of the face sheet 11 in contact with the center core member 13 is adhered to the center core member 13. The significance of the expression "entire surface" will be made clear in the following explanation of the adhesion of the face sheet 12 to the center core member 13. The face sheet 12 and the center core member 13 are adhered only at an adhesion portion 12*b*, but are not adhered at a remaining non-adhesion portion 12*a*. The non-adhesion of the portion 12*a* can be obtained by avoiding any coating of adhesion agent on this portion. The non-adhesion portion 12*a* is on a side of the panel on which a bending processing is to be carried out.

A length of the face sheet 12 is shorter than the length of the face sheet 11 by a length 12*c*, as seen in FIG. 1. The face sheet 12 is bent to form an inner side of the composite panel. In this regard, when the bending processing of the composite panel is carried out, between the face sheet 11 and the face sheet 12, a peripheral length difference 12*c* is generated. Thus, the inner side face sheet 12 is shorter than the face sheet 11 by this peripheral length difference 12*c*.

Next, the bending processing method of producing the composite panel will be explained. FIG. 1 shows a state in which the above-stated composite panel is set on a bending processing device. Firstly, the composite panel is laid on a stationary table 30 and a bending table 40 of the bending processing device. The faces of the stationary table 30 and the bending table 40 are positioned in the same horizontal plane. The composite panel is laid on the stationary table 30 and the bending table 40 with the face sheet 12 facing up. The side of panel where the non-adhesion portion 12*a* is located, on which the bending processing is to be carried out, is located on the bending table 50.

Next, using vacuum pads 31 and 41 of a vacuum adsorption device, which is installed on the stationary table 30 and the bending table 40, the face sheet 11 is adsorbed and fixed in position on these tables. Next, a bending table 50 is lowered into contact with the face sheet 12 on the non-adhesion portion 12*a*.

Next, using a vacuum pad 51 of the vacuum adsorption device, which is installed on the bending table 50, the end of the face sheet 12 is adsorbed and fixed to the bending table 50. The vacuum adsorption pads 31, 41, and 51 are installed with a predetermined interval along the longitudinal direction (the axial direction of the center of the bending) of the stationary table 30 and the bending table 40, and the bending table 50.

Figure 2:
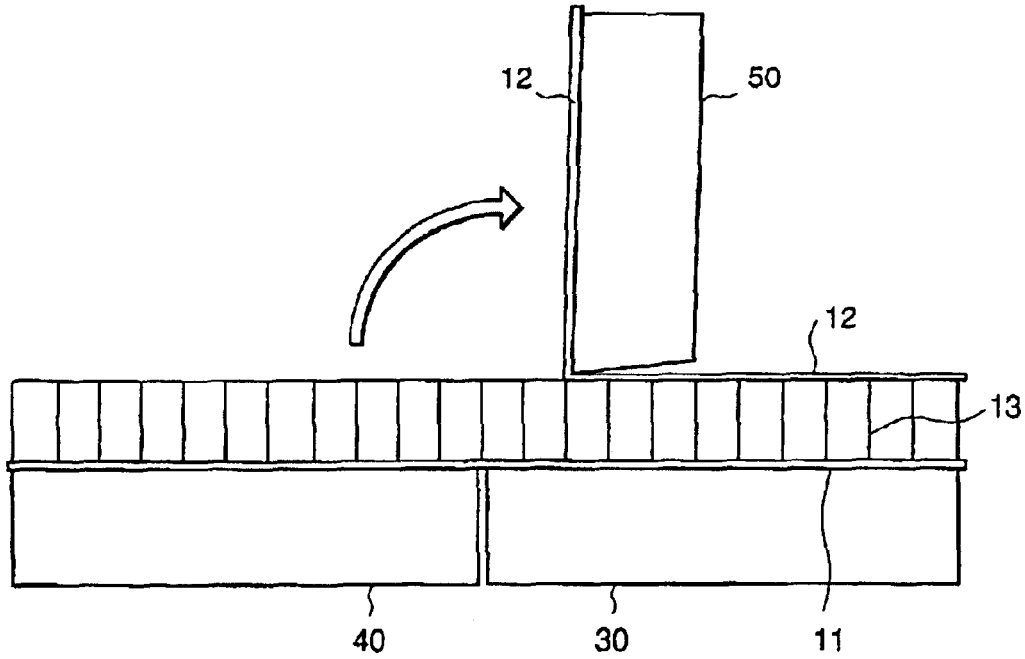
FIG. 2 is a longitudinal cross-sectional view showing a midway point of the bending processing using the bending processing device of FIG. 1.

Next, as shown in FIG. 2, by rotating the bending table 50, the portion of the face sheet 12 which forms the non-adhesion portion 12*a* is bent in the upper direction. In this embodiment according to the present invention, since the face sheet 12 is bent at a 90 degree angle, the contact face of the bending table 50 is rotated to be perpendicular to the plane of face sheet 12. The bending table 50 is positioned only at the non-adsorption portion 12*a*. An edge portion of the bending table 50 around which the bending occurs is positioned at a boundary of the non-adhesion portion 12*a* and the adhesion portion 12*b* or within the area of the non-adhesion portion 12*a*, a small distance from the boundary. The edge portion of the bending table 50 becomes a center axis of the bending rotation. The end at the boundary side of the bending table 50 is inclined (beveled) so as to not contact the face sheet 12 during rotation of the bending table 50.

Figure 3:
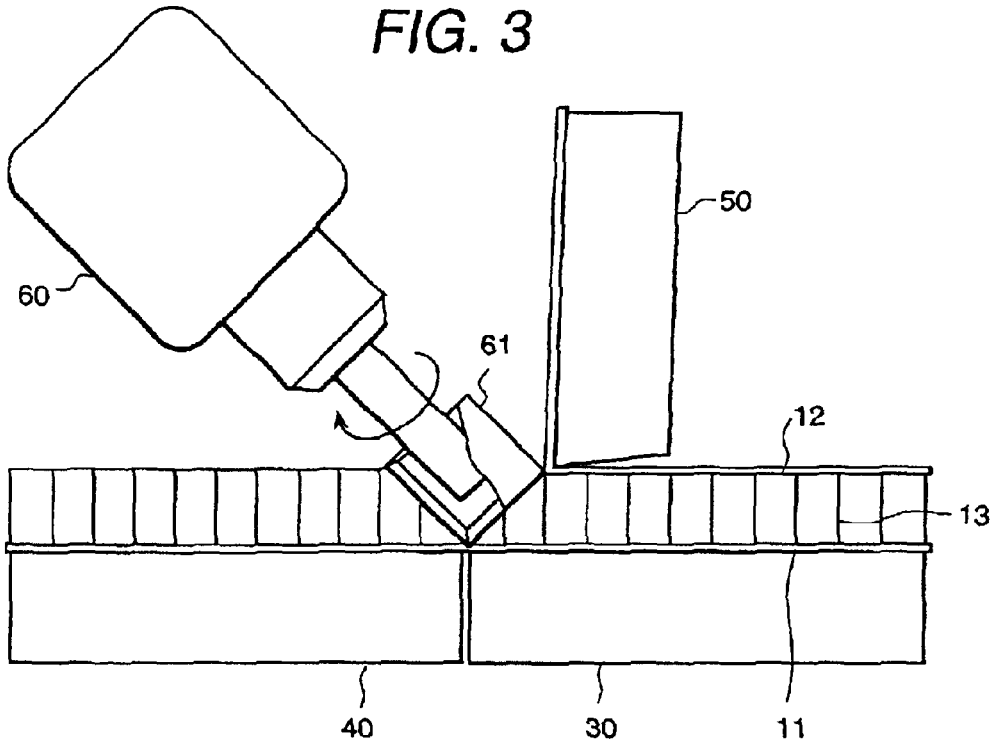
FIG. 3 is a longitudinal cross-sectional view showing a state of the bending processing following the step shown in FIG. 2 using the bending processing device of FIG. 1.

Next, as shown in FIG. 3, the exposed center core member 13 is cut with a V-shaped tool using a V-cutting device 60. The V-cutting is carried out so as to remove only a portion of the center core member 13 while leaving the face sheet 11 untouched. The position of the V-cutting is located at the bending position, and the angle of the V-cutting corresponds to the bending angle, which is a right angle of 90 degrees in this example. Using a knife 61 for carrying out the V-cutting, two faces are cut off at the same time. In the V-cutting, under a condition in which the knife 61, such as a router and an end milling tool, is inclined at a predetermined angle, the knife 61 is moved along the bending line, so that a portion of the center core member 13 is removed. Since the center core member 13 is formed by a paper center core member and a member in which a urethane-foam resin is filled in the paper center core member, even if a little of the center core member 13 is left on the face sheet 11 side, by carrying out the bending processing, any remaining portion the center core member 13 can be easily crushed.

Figure 4:
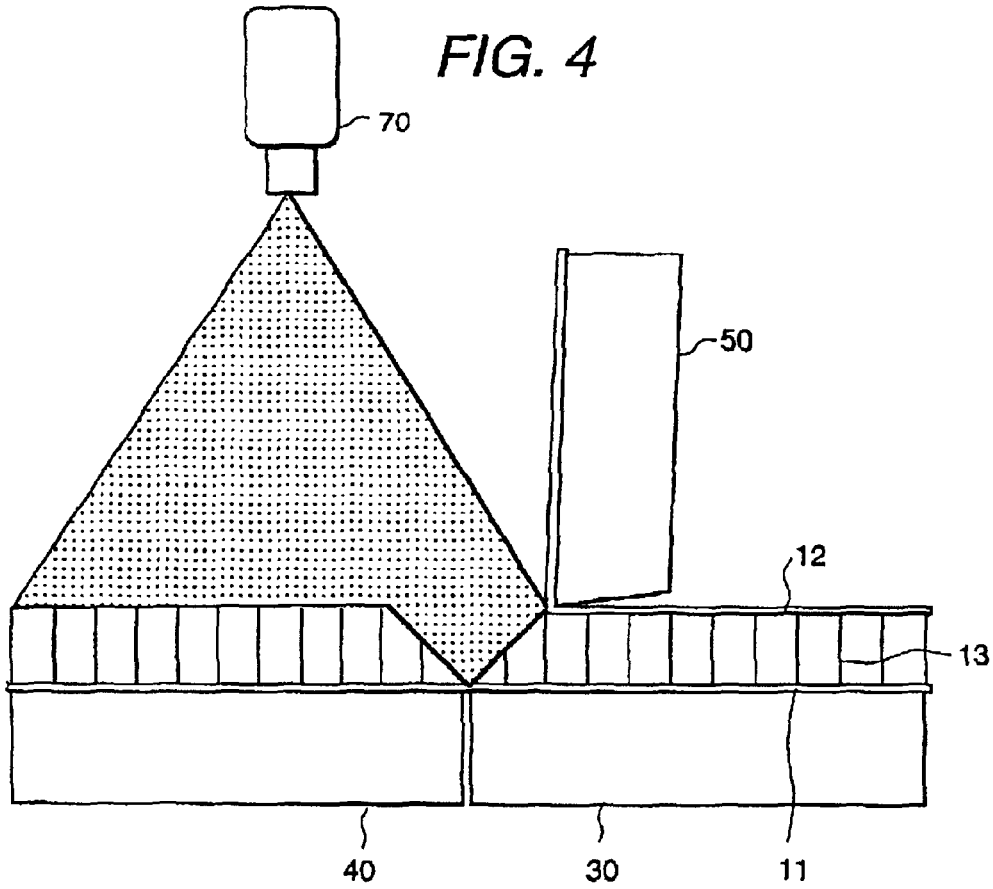
FIG. 4 is the longitudinal cross-sectional view showing a state of the bending processing following the step shown in FIG. 3 using the bending processing device of FIG. 1.

Next, as shown in FIG. 4, from the upper side, the non-adhesion portion 12*a* and the V-cut portion of the center core member 13 are coated with an adhesion agent using an adhesion agent coating device 70. At this time, since the gap between the face sheet 12 and the center core member 13 is relatively large, the adhesion agent coating can be carried out easily.

Figure 5:
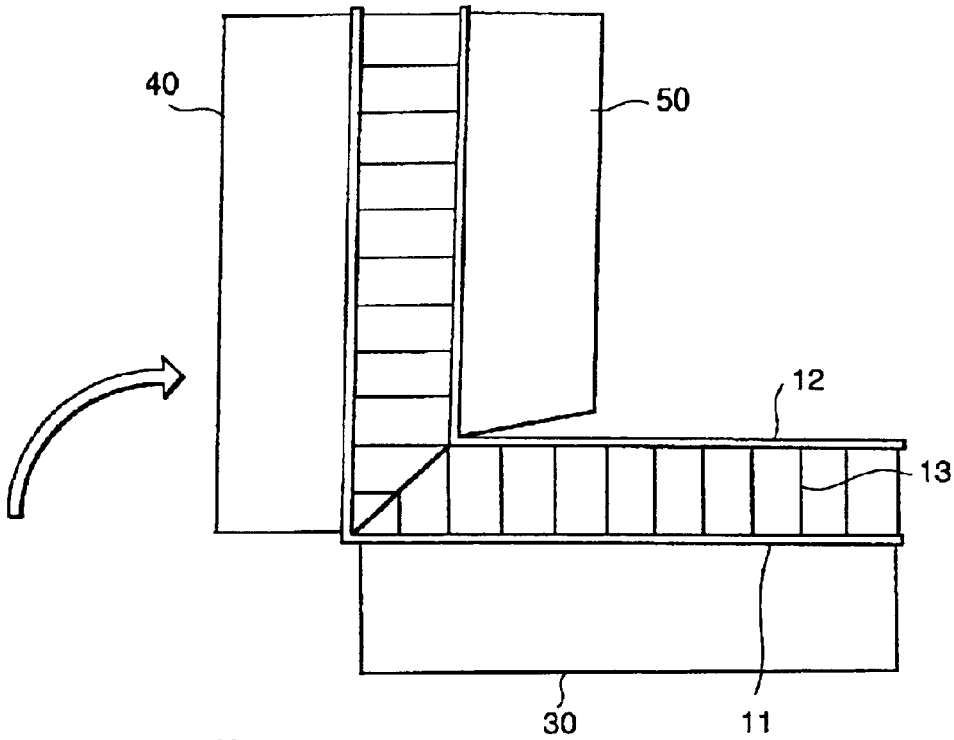
FIG. 5 is a longitudinal cross-sectional view showing a state of the bending processing following the step shown in FIG. 4 using the bending processing device of FIG. 1.

Next, as shown in FIG. 5, using the apex of the V-cut groove as a center of rotation, the bending table 40 is rotated until the face of the bending table 40 extends upward perpendicularly to the plane of the stationary table 30. With this movement, the surface of the center core member 13 on which the adhesion agent has been coated can be pressed into contact with the rear face of vertically extending portion of the face sheet 12. Further, the inclined faces of the V-cut groove in the center core member 13 are pressed together. In this condition, the position of the center core member 13 is maintained until the adhesion agent is hardened completely.

Next, after the vacuum of the adsorption pad 51 of the bending table 50 has been released, the bending table 50 is moved. Next, after the vacuum of the adsorption pad 41 of the bending table 40 has been released, the bending table 40 is rotated back to its initial horizontal orientation. Next, the composite panel on which the bending processing has been carried out is taken out from a side of the bending table 40, whereby the bending processing of the composite panel is completed.

According to the above-described bending processing method of production of the composite panel, the bending processing of the composite panel can be carried out without the occurrence of any gap or partial contact (the local application of pressure) between the face sheet 11 and the face sheet 12 and the center core member 13. Further, in the bending portion, since the face sheet 12 is not separated into two portions, after the bending processing of the composite panel has been carried out, it is unnecessary to weld the non-adhesion portion 12*a* and the adhesion portion 12*b* of the panel using another (separation) member.

Figure 6:
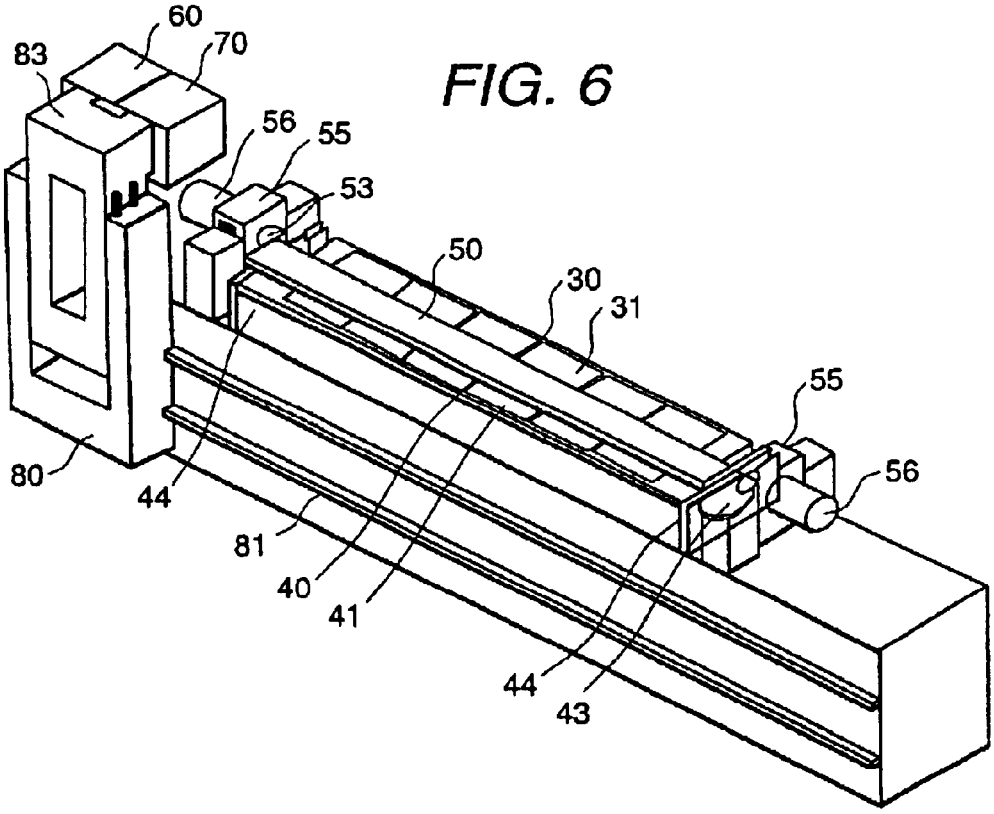
FIG. 6 is a perspective view showing the bending processing device of FIG. 1.

As seen in FIG. 6, the V-cutting device 60 and the coating device 70 of the adhesion agent are installed on a moving body 80, which moves along rails 81 in the longitudinal direction of the composite panel. The moving body 80 moves along the rails 81, which are mounted on a side face of the bending processing device. The V-cutting device 60 and the adhesion agent coating device 70 arc carried by a lifting and lowering device 83, which is carried by the moving body 80. By selecting either the V-cutting device 60 or the adhesion agent coating device 70, it is possible to put these devices into use the practical use.

Both ends of the bending table 50 are installed on a shaft 53 which is freely rotatable and is carried on an ascending and descending device 55. The device 55 is raised and lowered vertically relative to the rail 81. The reference numeral 56 denotes a drive mechanism for effecting rotation of the shaft 53.

Figure 7:
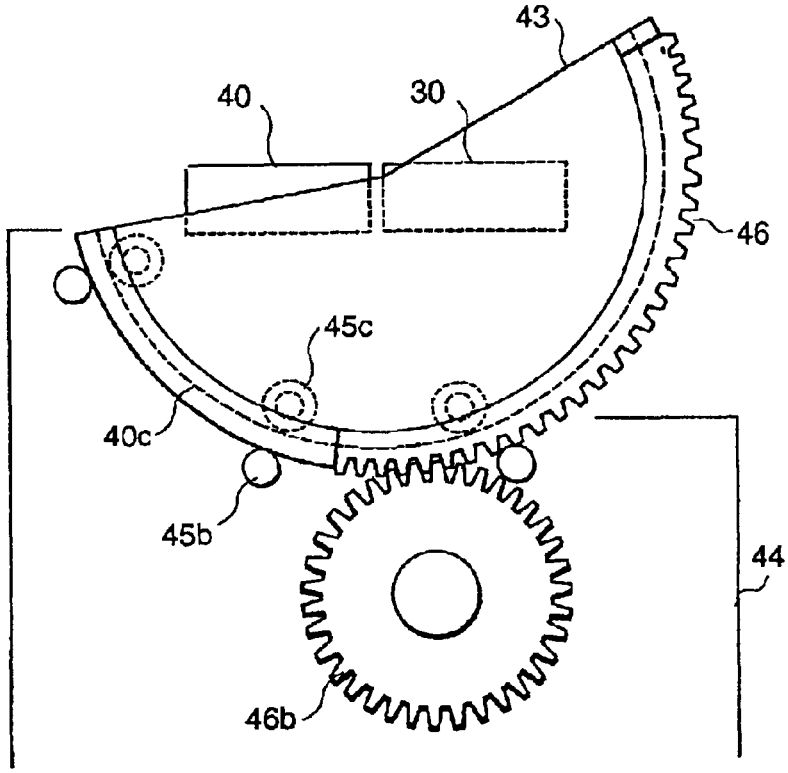
FIG. 7 is a front view showing an end portion of a bending table of the bending processing device of FIG. 1.
Figure 8:
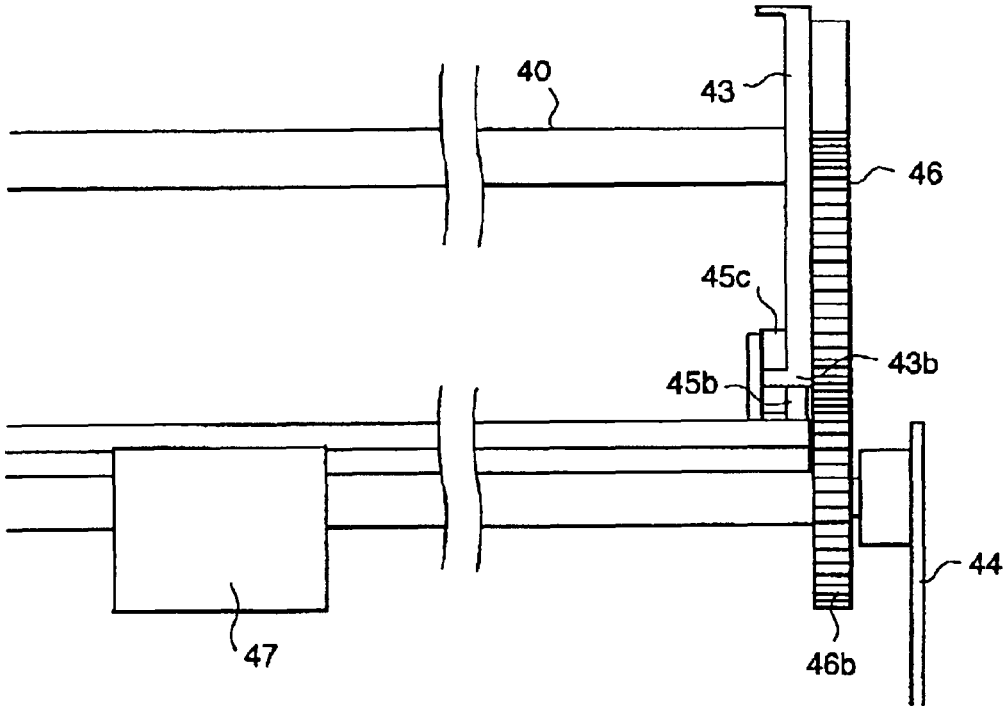
FIG. 8 is a longitudinal cross-sectional view of the end portion of a bending table of the bending processing device of FIG. 7.

The rotation device for effecting rotation of the bending table 40 will be explained in more detail with reference to FIG. 7 and FIG. 8. At the both ends of the bending table 40, a semi-circular flange 43 is installed. This flange 43 is supported by plural rollers 45*b* and 45*c*, which are installed on a frame stand 44. The plural rollers 45*b* and 45*c* are installed so as to be arranged along and form a circular track. The rollers 45*b* support a lower face of the flange 43. The rollers 45*c* contact an upper face of a circular arc-shaped guide rail 43*b*, which projects outwardly from the flange 43. Further, to the lower face of the bending table 40, circular arc-shaped projection portions are provided with a predetermined interval and are supported by the frame stand 44.

To the left side and the right side of the flange 43, gear tracks 46 are installed. The gear tracks 46 have a rotation angle corresponding to the movement of the bending table 40. On the frame stand 44, pinion gears 46*b* for meshing with the gear tracks 46 are provided. The pinion gears 46*b* at both sides are rotated by a single motor 47.

In the above-described embodiment according to the present invention, the bending angle is 90 degrees, but in the case of a panel having another angle, the V-cutting is carried out to provide a groove of the required. For example, an end milling having the same bending angle as the angle forming an axial end and a side face of the end milling is used. Further, even when the angle of the V-cutting is smaller than the bending angle, the center core member 13 can be easily crushed, so that the bending processing of the composite panel can be carried out.

The adhesion agent can also be coated on the surface of the face sheet 12 facing the center core member 13. However, when the adhesion agent is coated on the V-cut portion, a high strength can be obtained, so that it is preferable to apply the adhesive coating on the center core member 13.

The technical range according to the present invention is not limited by the described embodiments or the features illustrated in the drawings, but includes a range of equivalents which would be within the technical understanding of one skilled in the art to which the invention relates.

According to the present invention, a portion of one sheet which is not adhered to the center core member is bent, the center core member is removed to form a V-groove, next an adhesion agent is coated, and then the other face sheet is folded until the center core member becomes adhered to the bent fact sheet. In this way, neither a gap between the face sheet and the center core member nor partial contact (the local application of pressure) are created, so that it is possible to carry out the bending processing of the composite panel. Since the cutting of the face sheet is unnecessary, but the face sheet remain continuous, an adequate strength can be assured in the bending processing portion.

What is claimed is:

1. A composite panel, comprising:

a flat center core member having first and second major surfaces;

a first flat face sheet having a length substantially equal to a length of the flat center core member and being adhered to substantially all of the first major surface of the flat center core member; and a second flat face sheet having a length shorter than the length of the flat center core member and having a first end portion adhered to a first end portion of the second major surface of the flat center core member, and a second end portion including a second end terminating short of a second end of the flat center core member, the second end portion of the second flat face sheet not being adhered to the second major surface of the flat center core member, and a thickness of the second flat face sheet being less than that of the flat center core member.

2. The composite panel according to claim 1, wherein the first flat face sheet is made of a material selected from the group consisting of metal, fiber reinforced plastic and paper, the flat center core is made of a material selected from the group consisting of a honeycomb-shaped paper, a honeycomb-shaped fiber reinforced plastic and foam material, and the second flat face plate is made of a material selected from the group consisting of metal, fiber reinforced plastic and paper.

3. The composite panel according to claim 2, wherein a thickness of each of the first and second flat face plates is in a range of about 0.5 mm–2.0 mm, and a thickness of the flat center core member is in a range of about 20 mm to 50 mm.

4. The composite panel according to claim 1, wherein the first flat face sheet is made of a material selected from the group consisting of metal, fiber reinforced plastic and paper.

5. The composite panel according to claim 1, wherein the flat center core is made of a material selected from the group consisting of a honeycomb-shaped paper, a honeycomb-shaped fiber reinforced plastic and foam material.

6. The composite panel according to claim 1, wherein the second flat face plate is made of a material selected from the group consisting of metal, fiber reinforced plastic and paper.

7. The composite panel according to claim 1, wherein a thickness of each of the first and second flat face plates is in a range of about 0.5 mm–2.0 mm, and a thickness of the flat center core member is in a range of about 20 mm to 50 mm.

8. The composite panel according to claim 1, wherein a thickness of each of the first and second flat face plates is in a range of about 0.5 mm–2.0 mm.

9. The composite panel according to claim 1, wherein a thickness of the flat center core member is in a range of about 20 mm to 50 mm.

10. The composite panel according to claim 1, wherein the first flat face sheet is adhered to the flat center core member by one of soldering, welding and by an adhesive coating.

11. The composite panel according to claim 1, wherein the first end portion of the second flat face sheet is adhered to the first end portion of the flat center core member by one of soldering, welding and by an adhesive coating.

12. A composite panel, comprising:

a flat center core member made of a material selected from the group consisting of a honeycomb-shaped paper, a honeycomb-shaped fiber reinforced plastic and foam material and having first and second major surfaces;

a first flat face sheet made of a material selected from the group consisting of metal, fiber reinforced plastic and paper and having a length substantially equal to a length of the flat center core member and being adhered to substantially all of the first major surface of the flat center core member; and a second flat face sheet made of a material selected from the group consisting of metal, fiber reinforced plastic and paper, having a length shorter than the length of the flat center core member and having a first end portion adhered to a first end portion of the second major surface of the flat center core member, and a second end portion including a second end terminating short of a second end of the flat center core member, the second end portion of the second flat face sheet not being adhered to the second major surface of the flat center core member.

13. The composite panel according to claim 12, wherein a thickness of each of the first and second flat face plates is in a range of about 0.5 mm–2.0 mm, and a thickness of the flat center core member is in a range of about 20 mm to 50 mm.

14. The composite panel according to claim 12, wherein a thickness of each of the first and second flat face plates is in a range of about 0.5 mm–2.0 mm.

15. The composite panel according to claim 12, wherein a thickness of the flat center core member is in a range of about 20 mm to 50 mm.

16. The composite panel according to claim 12, wherein the first flat face sheet is adhered to the flat center core member by one of soldering, welding and by an adhesive coating.

17. The composite panel according to claim 12, wherein the first end portion of the second flat face sheet is adhered to the first end portion of the flat center core member by one of soldering, welding and by an adhesive coating.

18. A bent composite panel, produced by a process comprising:

providing a flat composite panel comprising a flat center core member having first and second major surfaces, a flat first face sheet having a length substantially equal to a length of the flat center core member and being adhered to substantially all of the first major surface of the flat center core member, and a flat second face sheet having a length shorter than the length of the flat center core member and having a first end portion adhered to a first end portion of the second major surface of the flat center core member, and a second end portion including a second end terminating short of a second end of the flat center core member, the second end portion of the flat second face sheet not being adhered to the second major surface of the flat center core member;

bending the flat second face sheet at a bending position so as to bend the second end portion of the second face sheet away from the flat center core member;

cutting a V-shaped cut-out in the second major surface of the flat center core member at a portion adjacent the bending position;

bending the flat center core member and the first flat face sheet about an apex of the V-shaped cut-out; and adhering the second major surface of the center core member to the second end portion of the second face sheet.

19. The bent composite panel according to claim 18, wherein the second major surface of the center core member is adhered to the second end portion of the second face sheet by applying an adhesive agent to a portion of the second major surface of the center core member, including the V-shaped cut-out exposed by the bending of the second face sheet and by the cutting of the center core member, and pressing the portion of the second major surface of the center core member to the second face sheet and pressing the inclined faces of the V-shaped cut-out to each other.

20. The bent composite panel according to claim 18, wherein the first face sheet is made of a material selected from the group consisting of metal, fiber reinforced plastic and paper, the center core is made of a material selected from the group consisting of a honeycomb-shaped paper, a honeycomb-shaped fiber reinforced plastic and foam material, and the second face plate is made of a material selected from the group consisting of metal, fiber reinforced plastic and paper.

21. The bent composite panel according to claim 20, wherein a thickness of each of the first and second face plates is in a range of about 0.5 mm–2.0 mm, and a thickness of the center core member is in a range of about 20 mm to 50 mm.

22. The bent composite panel according to claim 18, wherein the first face sheet is made of a material selected from the group consisting of metal, fiber reinforced plastic and paper.

23. The bent composite panel according to claim 18, wherein the center core is made of a material selected from the group consisting of a honeycomb-shaped paper, a honeycomb-shaped fiber reinforced plastic and foam material.

24. The bent composite panel according to claim 18, wherein the second face plate is made of a material selected from the group consisting of metal, fiber reinforced plastic and paper.

25. The bent composite panel according to claim 18, wherein a thickness of each of the first and second face plates is in a range of about 0.5 mm–2.0 mm, and a thickness of the center core member is in a range of about 20 mm to 50 mm.

26. The bent composite panel according to claim 18, wherein a thickness of each of the first and second face plates is in a range of about 0.5 mm–2.0 mm.

27. The bent composite panel according to claim 18, wherein a thickness of the center core member is in a range of about 20 mm to 50 mm.

28. The bent composite panel according to claim 18, wherein that first face sheet is adhered to the center core member by one of soldering, welding and by an adhesive coating.

29. The bent composite panel according to claim 18, wherein the first end portion of the second face sheet is adhered to the first end portion of the center core member by one of soldering, welding and by an adhesive coating.

* * * * *